United States Patent [19]

Wilnau

[11] 4,409,764

[45] Oct. 18, 1983

[54] SYSTEM AND METHOD FOR REINFORCED CONCRETE CONSTRUCTION

[75] Inventor: John A. Wilnau, Orlando, Fla.

[73] Assignees: Ennis H. Proctor; Donald C. Proctor; Donald C. Page, all of Ormond Beach, Fla.

[21] Appl. No.: 917,550

[22] Filed: Jun. 21, 1978

Related U.S. Application Data

[63] Continuation-in-part of Ser. No. 711,060, Aug. 2, 1976, abandoned, and Ser. No. 827,960, Aug. 27, 1977, abandoned, each is a continuation of Ser. No. 593,371, Jul. 7, 1975, abandoned.

[51] Int. Cl.[3] ..... E04B 1/19

[52] U.S. Cl. ..... 52/127.3; 52/252; 52/724; 52/725; 52/741; 52/204

[58] Field of Search ..... 52/251, 252, 222, 223 R, 52/741, 724, 725, 687, 220, 204, 127.3, 127.4

[56] References Cited

U.S. PATENT DOCUMENTS

| | | | |
|---|---|---|---|
| 957,414 | 5/1910 | Fisher | 249/50 X |
| 1,050,816 | 1/1913 | Deslauriers | 249/49 |
| 1,053,646 | 2/1913 | Roberts | 52/725 X |
| 1,069,421 | 8/1913 | Hobbs | 52/223 R |
| 1,119,969 | 12/1914 | Longevin | 249/26 |
| 1,135,721 | 4/1915 | Robinson | 52/724 |
| 1,142,887 | 6/1915 | Keenan | 249/27 X |
| 1,229,365 | 6/1917 | Wiegand | 249/42 |
| 1,482,813 | 2/1924 | Samaha | 52/250 |
| 1,794,079 | 2/1931 | Kellett | 52/724 X |
| 2,019,195 | 10/1935 | Simpson | 249/27 |
| 2,058,135 | 10/1936 | Colville | 52/725 X |
| 2,185,860 | 1/1940 | McAlpine | 249/26 |
| 2,731,824 | 1/1956 | Hadley | 52/724 |
| 2,823,440 | 2/1958 | Schade | 249/50 |
| 2,991,533 | 7/1961 | Reid et al. | 249/134 X |
| 3,076,293 | 2/1963 | Baudoux | 52/220 |
| 3,263,956 | 8/1966 | Hawkins | 249/30 X |
| 3,603,052 | 9/1971 | Novoa | 52/725 |
| 4,096,676 | 6/1978 | Hébert | 52/220 |

FOREIGN PATENT DOCUMENTS

| | | | |
|---|---|---|---|
| 1905341 | 8/1970 | Fed. Rep. of Germany | 52/426 |
| 2143167 | 3/1973 | Fed. Rep. of Germany | 52/677 |
| 6405545 | 11/1965 | Netherlands | 52/653 |
| 109887 | 10/1966 | Norway | 52/687 |
| 212317 | 4/1967 | Sweden | 52/204 |
| 210311 | 9/1940 | Switzerland | 52/725 |
| 679574 | 9/1952 | United Kingdom | 249/48 |
| 745329 | 2/1956 | United Kingdom | 52/724 |

*Primary Examiner*—Alfred C. Perham

*Attorney, Agent, or Firm*—William M. Hobby, III

[57] ABSTRACT

A system for constructing the structural framework of a building or other structure of reinforced concrete is characterized by column and beam forms of sheet metal which remain in place as permanent parts of the framework after being filled with concrete. These forms are preferably factory-assembled, together with the necessary internal metal reinforcing skeletons, and shipped to the building site ready for erection of the column forms and interconnection thereof by the beam forms. Novel provisions are made, by means of walers and tensioned steel bands, for initially compressing opposed side walls of the forms to concave curvatures so that they are returned to essential flatness by the hydrostatic pressure of the fluid concrete.

6 Claims, 23 Drawing Figures

SYSTEM AND METHOD FOR REINFORCED CONCRETE CONSTRUCTION

This application is a continuation-in-part of application Ser. Nos. 711,060 and 827,960 filed Aug. 2, 1976 and Aug. 27, 1977 respectively as continuations of Ser. No. 593,371 filed July 7, 1975 and now abandoned.

BACKGROUND OF THE INVENTION

The invention relates to the construction of the structural framework of a building or other structure of reinforced concrete, and particularly to column and beam forms which would become integral parts of the structural framework and to methods of employing such forms.

In the past, there have been many systems for fabricating structural frameworks, including the use of steel frameworks for industrial type buildings because they are comparatively inexpensive to build and can be assembled rapidly. Such buildings, however, face a serious problem in their relatively low fire ratings, since a fire can cause rapid expansion of steel columns and beams, resulting in twisting and warping which may result in the necessity of complete replacement of the building.

Reinforced concrete offers substantial advantages over steel from the standpoint of fire rating, and many specially designed concrete forms for such use have been proposed in the past. Some such forms are made of construction grade lumber and plywood which must be assembled into predetermined shapes for receiving poured concrete. Forms which are to be used multiple times may also be made from metals having the necessary rigidity and strength to support the weight of the fluid concrete during its pouring and initial stages of curing. These forms are made in many types and shapes, and are provided with a variety of means for locking them in position for the pour and unlocking to facilitate their removal after the concrete is sufficiently hardened.

Removable forms in general can be characterized as relatively expensive in terms of both capital cost and use, having in mind that they must be cleaned or otherwise reconditioned after each use, as well as transported from site to site. Indeed, their initial cost is usually such that it can be justified only on the basis of multiple uses, thereby reducing their per building cost.

SUMMARY OF THE INVENTION

The major objective of the present invention is the provision of a system and method for use in building construction which will provide a structural framework of metal-reinforced concrete columns and beams permanently encased in the sheet metal forms wherein the concrete is poured. A more specific objective is the provision of such a system and method wherein the metal forms impart a finished appearance to the surfaces of the columns and beams which are exposed in the completed building and thereby contribute to the ultimate appearance of the building at minimal cost.

In accordance with the invention, the structural framework of a building or other structure, e.g. a bridge, is composed initially of sheet metal column forms which are erected on a concrete slab or other foundation and are interconnected with and by complementary sheet metal beam forms. Prior to the pouring of any concrete, and preferably prior to erection of the forms, each form is provided with an appropriate internally located skeleton of steel reinforcing bars, and the bars within each pair of interconnected forms are spliced together by additional bar members which bridge the joints between connected forms.

In the practice of the invention, the column and beam forms, along with the appropriate internal reinforcing skeletons, are erected on a concrete slab or other foundation at least to the level of the second story of the building, or the roof level for a one-story building. All the concrete for that much of the building framework may then be poured at a single time, filling the erected column forms and then the beam forms which have been mounted thereon. If the building is to have two or more floors, the column forms may be initially of the same height as the finished building, or single story column forms can be erected for each separate story on top of the forms already in place which have been filled with concrete, together with the necessary additional beam forms for each added story. The same procedure of pouring concrete for all column and beam forms in each successive story may then be followed until the entire building framework has been poured.

One of the major advantages provided by the invention is that the individual column and beam forms can be fabricated and provided with the proper internal reinforcing skeletons by factory labor, so that they can be shipped to the building site completely ready for erection. Thus the only stage in the fabrication of the building framework which is subject to weather conditions is the actual erection of the forms and the pouring of the concrete. Due to the construction of the individual forms in accordance with the invention, their erection and interconnection at the site require a minor fraction of the time required for conventional removable forms, which must be individually assembled on site.

A particularly important characteristic of the invention lies in the technique by which the invention assures that the finished columns and beams will have properly flat sides notwithstanding that the forms in which the concrete is poured are fabricated of relatively lightweight and flexible sheet metal. This result is accomplished in accordance with the invention by initially compressing opposed sides of the forms to concave curvatures by yieldable forces calculated to permit the initially compressed sides of the form to return to essentially flat condition in response to the hydrostatic pressure of fluid concrete filling them to the proper level. More specifically, opposed sides of the forms are compressed by waler means in combination with a plurality of spaced steel bands which are stretched to predetermined tension values calculated to counterbalance the hydrostatic pressure of fluid concrete filling the form only when the initially concave sides of the form have return to substantially flat condition.

While the individual forms with which the invention is practiced will result in greater cost per building than removable forms, because the forms of the invention remain as parts of the building as compared with the use of removable forms for multiple buildings, this capital cost is easily offset by savings in labor costs, and especially in time on the job.

For example, removable forms of conventional designs must be assembled from individual pieces on the job, and after the concrete is poured, they must remain in place for a prescribed period, especially on the under sides of the beams, to assure development of adequate strength in the concrete through its curing process. The shoring must also remain during the same period, and thereafter the forms must be dismantled and prepared for reuse. In contrast, because the forms of the invention remain as parts of the building, after the columns and beams for one floor have been poured, the forms for the next floor can be erected and poured as early as the next day.

Another important advantage of the invention is that the permanent metal forms impart such strength to the beams before the concrete has cured that much less shoring is needed than with conventional removable forms, and the shoring which is required can be removed much sooner than with conventional removable forms. This again results in considerable savings in both time and money, including reduction in the capital cost represented by the much smaller quantity of shoring required in the practice of the invention.

An additional advantage of the invention lies in its versatility in terms of the dimensions and shapes of beams with which it can be practiced, as will be more readily appreciated from the examples of special beam shapes which are described hereinafter.

In the finished structure, substantial areas of the outside surfaces of both the column and beam forms will remain exposed, and the different ways in which such exposed surfaces can be finished provide another aspect of the versatility of the invention. If, for example, the forms are made of inexpensive material such as cold rolled sheet steel, they can be painted as desired. Alternatively, they can be made of sheet metals havng naturally decorative surfaces, such as stainless steel or anodized aluminum.

BRIEF DESCRIPTION OF THE DRAWINGS

FIG. 17 is a diagrammatic cross section illustrating a column form in accordance with the invention designed to provide a chase for piping, wiring, or the like;

DESCRIPTION OF THE PREFERRED EMBODIMENTS

Figure 1:
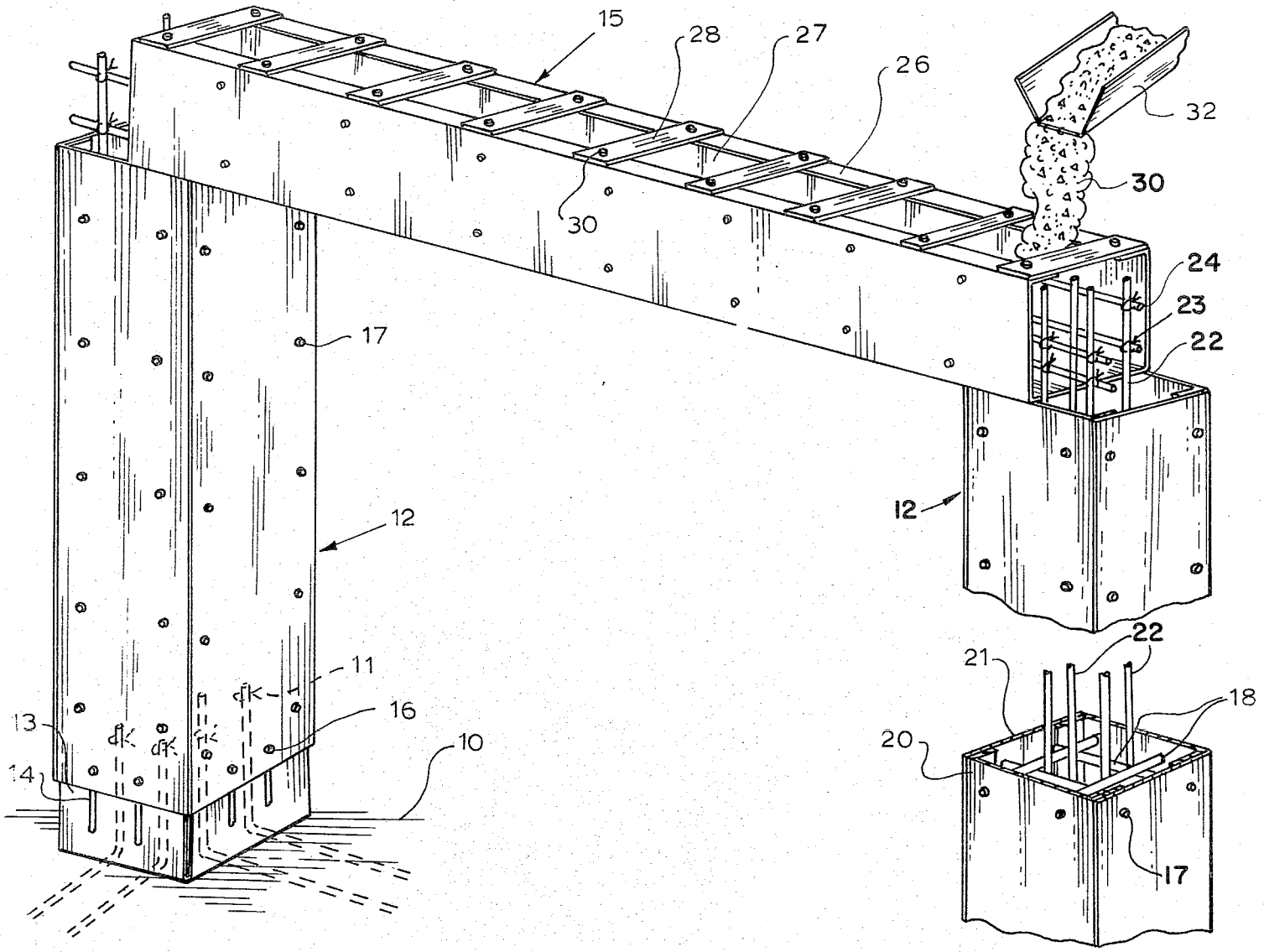
FIG. 1 is a cutaway perspective view of a portion of two column forms and a beam form in accordance with the present invention.
Figure 4:
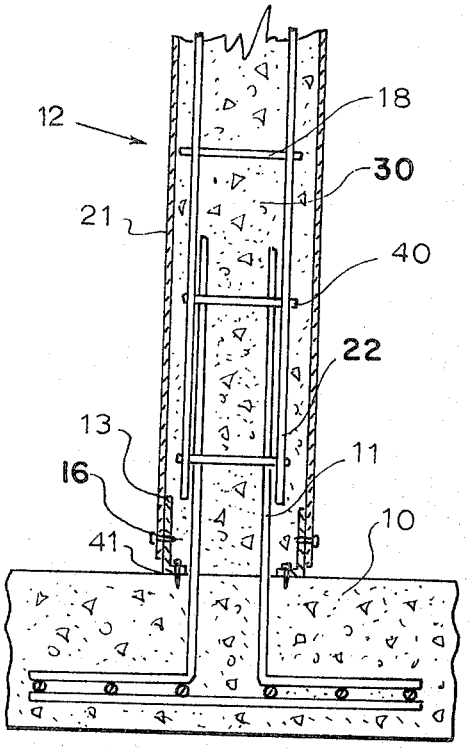
FIG. 4 is a sectional view of the connection between a vertical column and a poured concrete floor.

FIGS. 1 and 4 illustrate a portion of a column and beam structural framework anchored to a poured concrete foundation floor 10 by means of protruding reinforced steel bars 11 entering into the concrete within a column form 12. The form 12 telescopes over a foot anchor or shoe 13 having four sides and a plurality of slots 14 therein, allowing the form 12 to be adjusted for leveling the horizontal beam forms 15. Once levelled, the form 12 is bolted to the shoe 13 by screws 16 threaded into the slots 14 to lock the form 12 in predetermined position on the shoe 13.

The column form 12 has a plurality of opposed openings for receiving a plurality of bolts 17 threadedly locked into bracing rods 18 which are generally positioned with two pairs adjacent each other within the form 12. Each pair of rods 18 braces one pair of opposite side walls of the form, which is shown as comprising a pair of U-shaped side members 20 and a pair of sheet members 21 held together by sheet metal screws, welding, or by bolts 17 and bracing rods 18.

Figure 5:
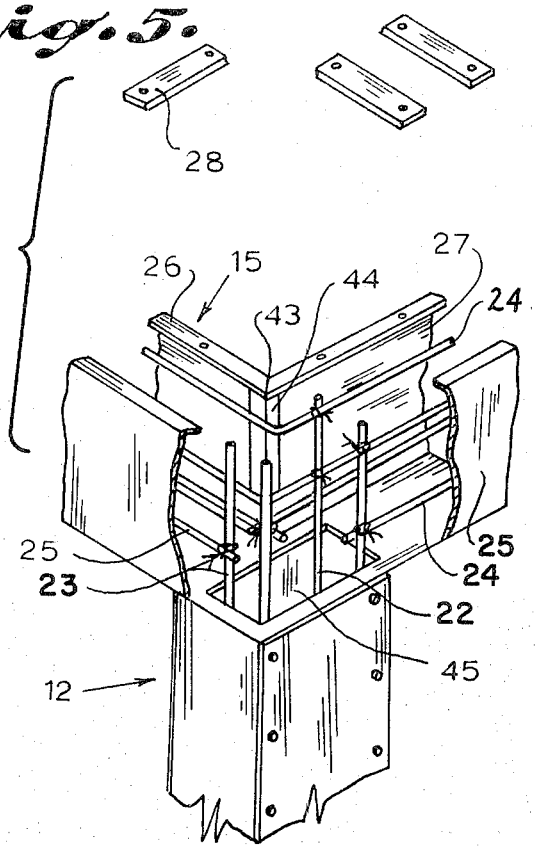
FIG. 5 is a cutaway perspective view of a portion of a corner connection between a column form and two horizontal beam forms.
Figure 6:
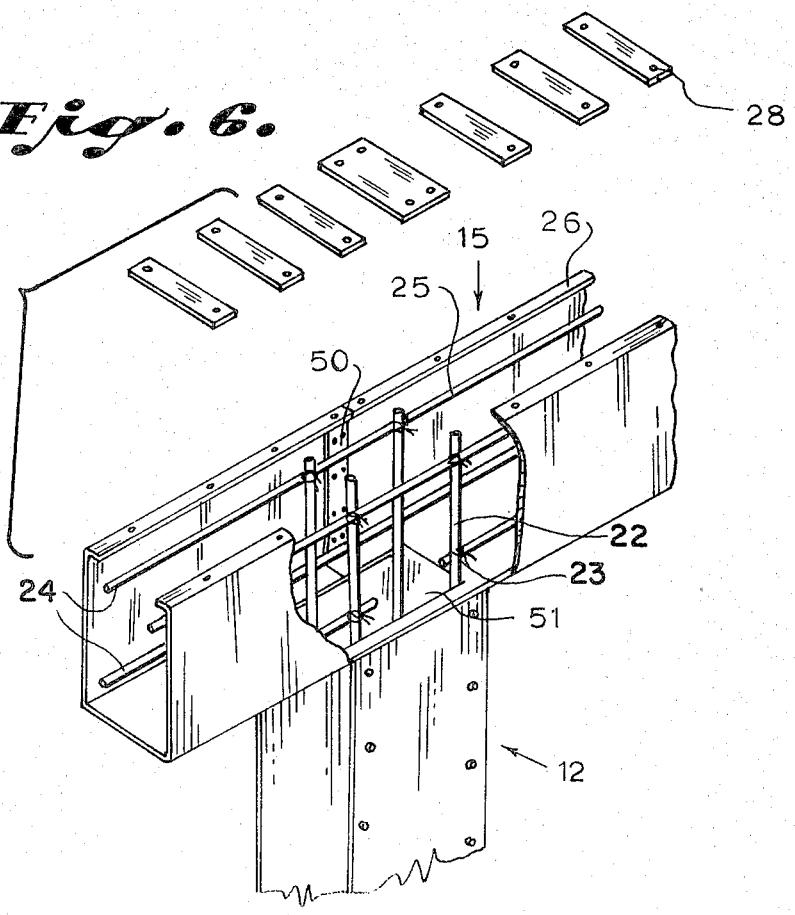
FIG. 6 is a cutaway perspective view of a T-joint between two beam forms on a supporting column form.

A plurality of concrete reinforcing steel bars 22 are attached to the bracing rods 18, by means of wire ties 23, to maintain the bars 22 in predetermined positions spaced inwardly of the inner surfaces of the form 12. Bars 22 ae similarly attached to similar reinforcing bars 24 projecting from adjacent beam forms 15, and also to the base anchoring bars 11, as shown in FIGS. 1, 5 and 6.

The horizontal beam form 15 is similar to the column forms 12 except that it comprises a U-shaped member 25 forming three side walls and inturned flanges 26 leaving an open side or slot 27. A plurality of spaced metal straps 28 are secured by welding or screws to the flanges 26 to hold the upper ends of the beam form side walls in fixed relation defining the open slot 27 through which concrete 30 can be poured from a chute 32 or other supply source. FIG. 1 shows the beam form 15 as of square section, but it will usually be rectangular and of substantially greater depth than width, e.g. 24 inches deep and 12 inches wide.

The rods 18 within both the column and beam forms may have internal threads in each tip thereof for a bolt 17, or may have a protruding end portion with external threads for threadedly attaching each end through the openings in the opposed form walls for further strengthening the column and beam forms 12 and 15 and for precisely locating and holding the reinforcing steel bars 22 and 24. Thus the bracing rods 18 form additional reinforcing within each poured concrete column and beam while the concrete is setting. Thereafter, the nuts or bolts by which the rods 18 are attached to the walls can be quickly removed, and the same threaded portions of the rods 18 used to attach steel or other wall panels to the inside and outside of the building structure. The completed poured concrete columns and beams are left with the inexpensive metal forms 12 and 15 surrounding them.

The resulting framework, which provides structural members of reinforced concrete with leave-in-place thin metal walls, substantially increases the fire rating of the completed building. Inasmuch as the walls have concrete columns and beams, they can stand long periods of high temperature, for instance, a four-hour rating, without being damaged or warped as with steel columns and beams used in steel buildings, and thereby promote the rapid repair of a fire damaged building and a reduced insurance ratee for the owner of the building.

Figure 2:
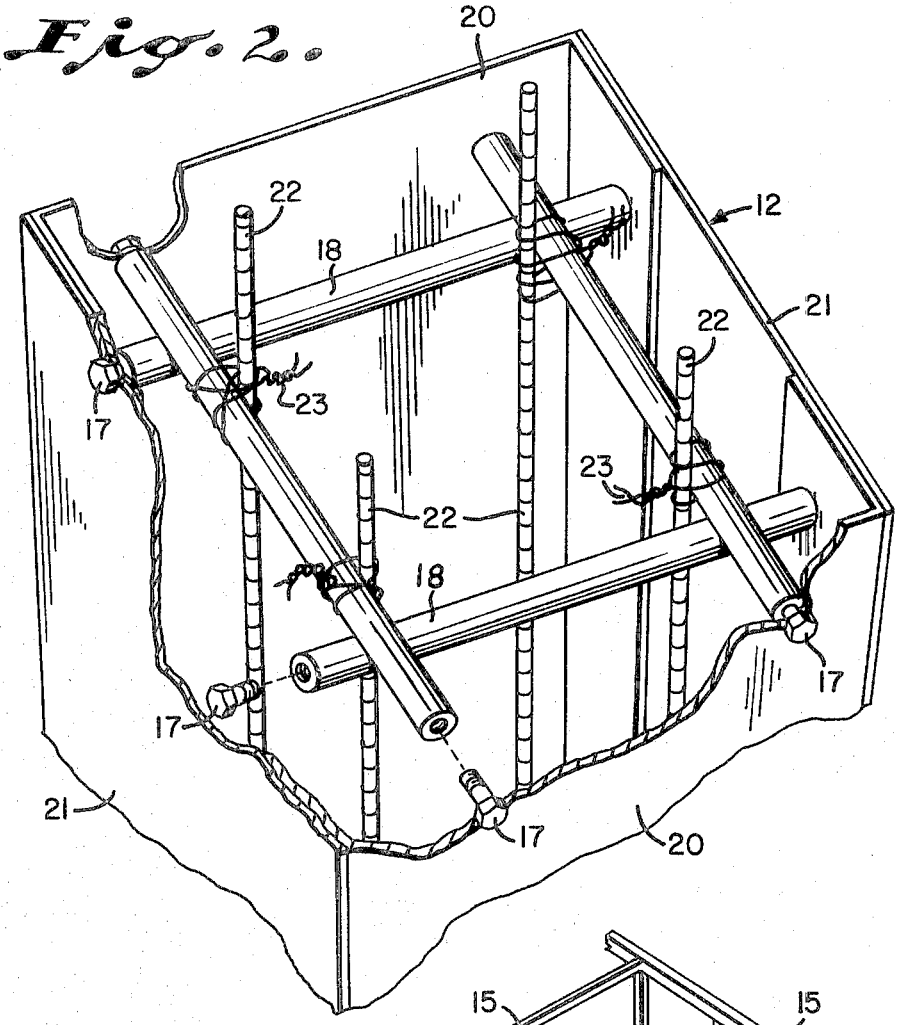
FIG. 2 is a cutaway perspective view of a portion of a column form.

FIG. 2 more clearly illustrates the use of the bracing rods 18 to support the reinforcing bars 22, which may be placed in each corner defined by intersecting bracing rods 18 and wrapped with wire 23 to hold them in place. This advantageously spaces the reinforcing bars 24 a predetermined distance within the forms 12 to promote the desired fire rating, which may be determined by the distance the bars are spaced interiorly of the outer surfaces of the reinforced concrete.

FIG. 4 more clearly illustrates the mounting of a column form 12 on a foundation 10 with the aid of the steel dowels 11 which are connected to the vertically extending reinforcing bars 22 utilizing a plurality of wire stirrups 40 for holding the unit in position until the concrete 30 has set to form the column. The rods 18 can be seen in this view as well as the shoe 13, which is secured by screws or other attaching members 41 to the foundation 10 and held by screws 16 passing through openings in the wall 21 to hold the form 12 in place. Alternatively, the screws 16 and slots 14 can be dispensed with, and each form 12 can be properly levelled by shims until the concrete 30 has been poured and set.

FIG. 5 illustrates the connection of a column form 12 to a pair of beam forms 15 in a miter joint 43 held with a small angle member 44 which may be screwed or welded in place at the miter joint 43. The vertical reinforcing bars 22 are connected to the horizontal reinforcing bars 24 by means of wire ties 23. The end of the beam form 15 may have cutawy portions 45 to provide a connection with the column form 12 so that when fluid concrete is poured into the open slot 27 of the beam form 15, it can flow into the vertical column forms 12, encapsulating the reinforcing bars 22 and 24 as well as the bracing rods 18 to the level of the flanges 26 of the beam forms 15.

FIG. 6 is a perspective view illustrating a T-joint in which a pair of beam forms 15 are connected. with joint connecting members 50, each having a cutaway portion 51 providing an opening into the vertical column form 12. Horizontal reinforcing bars 24 and vertical reinforcing rods 22 are again connected with wire 23 to each other, and are also held in place by the bracing rods 18 which are not illustrated in this view.

Figure 7:
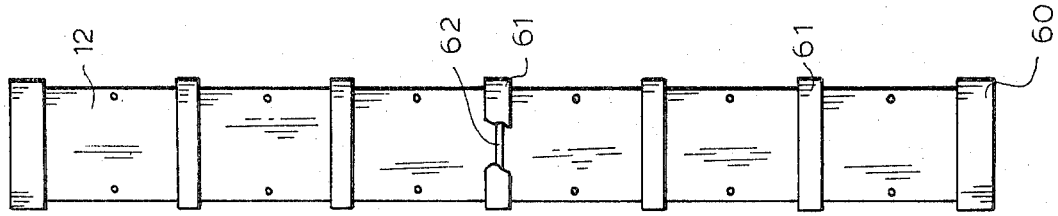
FIG. 7 is a side sectional view of a packaged column form.

FIG. 7 shows a column form packaged for shipment with corrugated board members 60 covering each end of the form and a plurality of corrugated board straps 61 wrapped around the form. The straps 61 have steel straps 62 fastened therearound to hold the corrugated board in place. This packaging serves to prevent the forms 12 from getting scratched, and also provides additional reinforcing against the static pressure of the concrete when the form is filled. Thus straps 62 would not be removed until the columns were poured and set.

The invention is utilized by erection of each of the vertical column forms 12 and attachment of the beam forms 15 to each other and to their respective reinforcing bars 22 and 24. Once a complete system is set up, concrete is poured to fill the column forms 12 and the beam forms 15, encapsulating the reinforcing bars 22 and 24 and the bracing rods 18. After the concrete has set, the bolts 17 can be removed from the threaded openings in the rods 18, which are encapsulated in concrete, and the bolts 17 may be used to attached wall panels to the completed columns and beams. It is also contemplated that the columns may form pilasters on the interior of the building and can have their surfaces enhanced by the attachment of elongated angle iron members to the threaded ends of the rods 18, or by welding to the sides of the forms, for attaching wall paneling to cover the columns.

Figure 3:
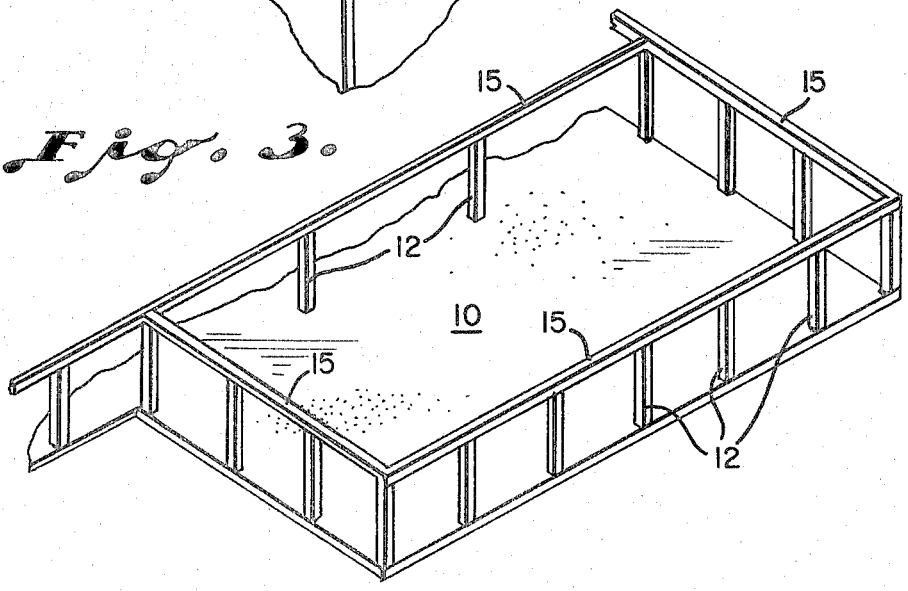
FIG. 3 is a perspective view of a group of interconnected column and beam forms.

FIG. 3 illustrates the use of a plurality of column forms 12 connected to a plurality of horizontal beam forms 15 to define the structural framework of a building. After the interconnected forms have been filled with concrete which has had time to set, the resulting framework is ready for the attachment of wall panels and a roof. It should, however, be clear that multistoried buildings can be formed by pouring the first level, mounting additional forms thereon for the pouring of the next level in the same manner, and so forth.

Figure 8:
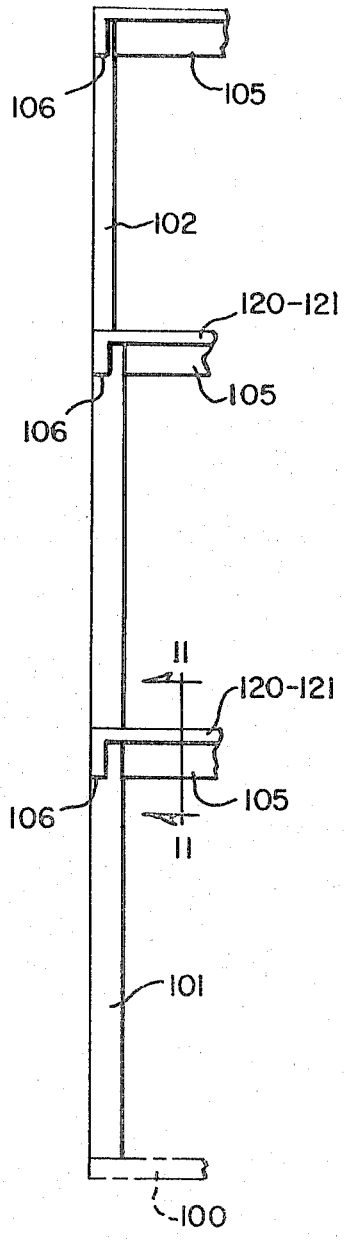
FIG. 8 is a fragmentary elevation of column and beam forms in accordance with the invention in a multistory arrangement.
Figure 9:
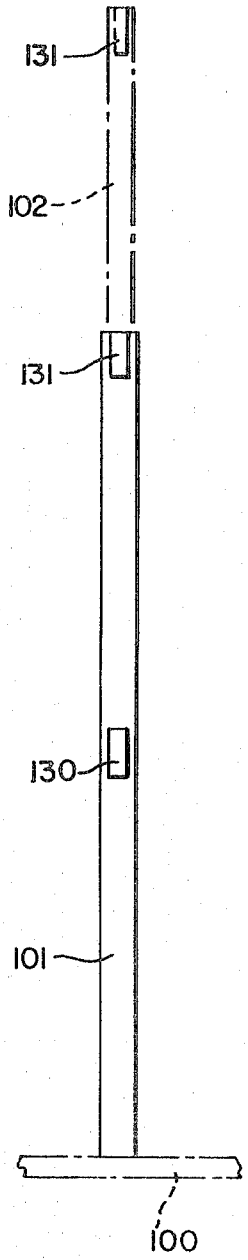
FIG. 9 is an elevation of the column forms in FIG. 8 looking from right to left in FIG. 8.

FIG. 8 illustrates the application of the invention to a multi-story building on a foundation slab 100, utilizing column forms 101 and 102, and beam forms 105 and 106. In FIG. 8, the column forms 101 for the second and third floors are shown as of larger section than the column forms 102 for the third floor, e.g. 2 ft. square for the lower floors and 1 ft. square for the roof. The beam forms 105 and 106 are shown as of the same dimensions for all floors, e.g. 1 ft. thick and 2 ft. high.

Except for the differences in dimensions, the forms 101 and 102 are of the same configuration, each being composed of a pair of U-shaped members 110 of steel sheet of suitable quality, e.g. 12-gauge, with inturned flanges 111 along both edges. The form is completed by assembling the members 110 with their flange portions 111 in abutting relation, and then welding the assembled members together at appropriately spaced intervals.

The beam forms 105 are formed of two sheet metal members 115 of generally L-shaped section, each of which is also provided with flanges 116 and 117 as shown extending at right angles inwardly from the edges of the L-shaped portion. The form 105 is assembled by welding the two L-shaped members 115 together along the abutting flanges 116, and by welding or bolting connecting straps 118 to the opposed flanges 117 at spaced intervals leaving slot openings between the flanges 117.

The beam forms 106 are of somewhat different construction from the beam forms 105 in order to adapt them to use with a precast floor slab 120 (FIG. 10) of conventional construction forming a support for a topping layer 121 of reinforced concrete which is poured thereon in place and anchored to the adjacent concrete beam by right angled reinforcing bars 123. For this purpose, each beam form 106 includes one L-shaped component member 115 and a second L-shaped component member 125 which is of greater height than the member 115 by an amount substantially equal to the vertical thickness of the completed slab 120 with its concrete topping 121. The member 125 includes flanges 126 and 127 which correspond to the flanges 116 and 117, and which are connected by inclined straps 128 corresponding in spacing and function with the straps 118.

Figure 10:
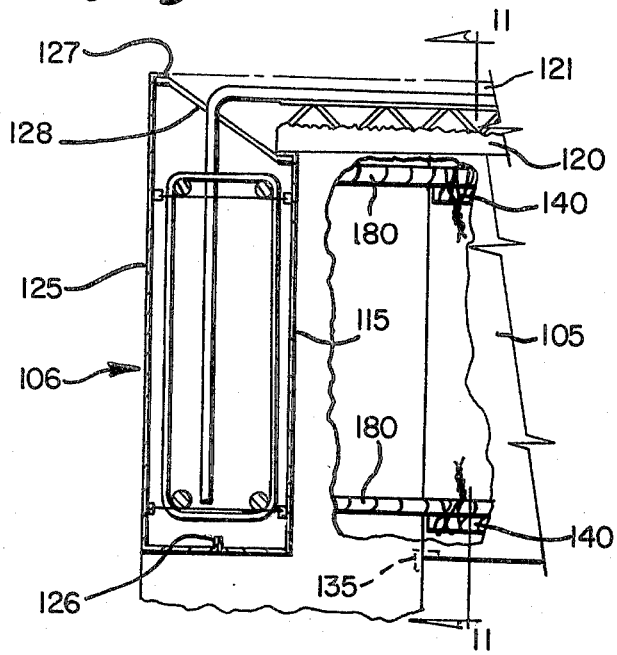
FIG. 10 is a fragmentary view partially in section on the line 10—10 in FIG. 11.
Figure 11:
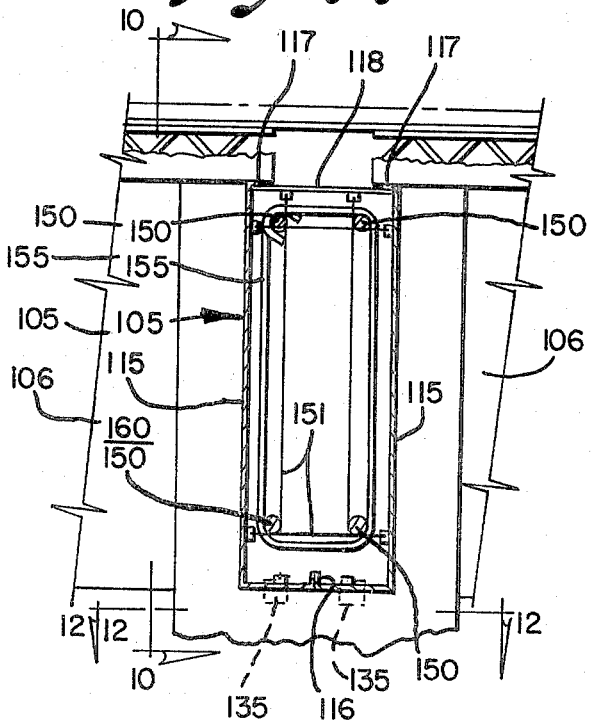
FIG. 11 is a fragmentary section on the line 11—11 in each of FIGS. 8 and 10.

The beam forms 106 are utilized to form the spandrel beams along the exterior of the building framework as shown in FIG. 10, and the beam forms 105 are utilized interiorly of the framework, as shown in FIG. 11. The flange 117 along the inner side of each form 106 defines a shelf for receiving and supporting the edge of the slab 120. Then when the concrete topping 121 is subsequently poured, the portion of the L-shaped component 125 above the level of flange 117 forms a dam enclosing the space between itself and the edge of the slab 120 which will also be filled with concrete.

The column forms 101 are shown as of a height reaching to the level of the slab for the third floor of the building. Each of these forms which is located on the exterior of the structural framework has rectangular cut-outs 130 at the appropriate levels and locations in its faces to receive the beam forms 105 and 106 for the second floor of the buildings, and similarly located rectangular slots 131 at its upper end which will match the beam forms 105 and 106 for the third floor. The column forms 102 are provided with similar slots at their upper ends which match with the beam forms for the roof of the building.

Similarly cut-out and slotted multi-story forms can also be used interiorly of the building. If, however, the height of the interior column forms is limited to a single story, they can be of a height matching the bottoms of the beam forms. In this case, the beam forms will rest on top thereof with their ends in abutting relation, and their bottom sides will be cut out for flow of concrete into the column form, essentially as shown in FIG. 6.

In the initial construction of the building framework, the column forms 10 are erected on the foundation floor 100 in the manner and by the means already described in connection with the column forms 12. The beam forms 105 and 106 for the second floor are then mounted in the proper positions on the erected column forms 101. For this purpose, each of the beam forms has one or more angle brackets 135 welded or otherwise secured to the bottom edge of each end thereof in position to hook over the bottom edge of the associated cut-out 130 or slot 131. After each beam form is thus temporarily latched in place, it is permanently secured as by stitch or seam welding or other suitable means.

Thus at one stage in the erection of the building, the framework will comprise the appropriate number of column forms 101 permanently secured to the appropriate number of beam forms 105 and 106 for at least the second floor. If the building is not too high for an available crane, all the forms can be mounted and inter-connected before any concrete is poured. Alternatively, the forms for one or more higher floors can be erected while the concrete in the forms for one or more lower floors is setting, e.g. on the day following pouring.

Figure 12:
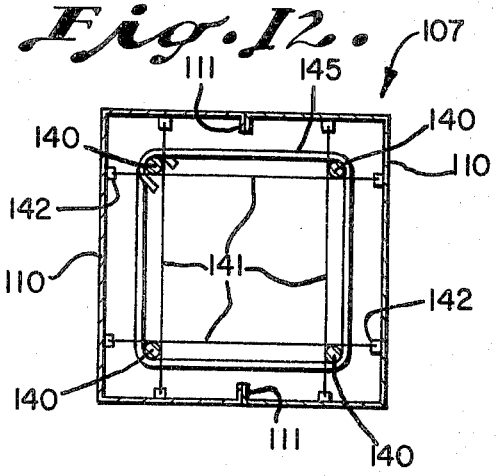
FIG. 12 is a section on the line 12—12 in FIG. 11.

Preferred results are obtained by supporting the reinforcing bars 140 as shown in FIG. 12, by means of a plurality of vertically spaced sets of four pieces 141 of stiff but relatively light gauge wire provided with plastic caps 142 on each end thereof and dimensioned to fit tightly across the width of the interior of each column form. These wires 141 are welded together at the points where they cross each other, and the four reinforcing bars 140 are positioned as shown in FIG. 11, on the two exterior corners defined by the upper pair of crossed ends of wires 141, and on the bottom horizontal wire 141. The bars 140 are also encircled by wire stirrups 145 at appropriately spaced intervals, in accordance with conventional practice.

There is similar internal reinforcing for each of the beam forms 105 and 106 as shown in FIGS. 11 and 12. It comprises a minimum of four reinforcing bars 150 in supporting assemblies composed of four wires 151 provided with plastic caps 152. Wire stirrups 155 encircle the bars 150 at appropriate intervals along the length of the beam. Additional reinforcing bars 150 can be employed if desired, and can be mounted internally of the stirrups 155 and secured thereto by wire ties.

An important advantage of the internal reinforcing arrangement shown in FIGS. 10–12 is that it is unnecessary to provide any holes in the forms themselves, and another advantage is that all of the reinforcing metal is retained in interiorly spaced relation with the inner surface of the form, and is insulated against heat applied to the exterior of the finished wall, as in the case of fire. Thus except for the supporting wires 141 and 151, all of the reinforcing structure is readily located in whatever interiorly spaced relation within the form shell is desired, e.g. approximately two inches, and the plastic caps 142 and 152 insulate the wires 141 and 151 against direct conduction of heat from the metal of the form.

An alternative arrangement for supporting the reinforcing bar skeleton in internally spaced and heat insulated relation with the form is illustrated in connection with the column form 101 in FIGS. 13–15. It comprises four U-shaped wire clips 156 having their rounded ends located in the four corners of the form and their leg portions secured to the associated reinforcing bars 140, as by clamping or spot welding. Preferably the rounded portions of the clips 156 are covered with plastic material for heat insulating purposes. Essentially the same arrangement can be used in the beam forms of the invention.

Because the forms 101, 102, 105 and 106 are preferably made of relatively thin and inexpensive sheet steel, they are subject to deflection by the hydrostatic forces applied thereto by fluid concrete before the concrete has set. This tendency to deflection increases with the cross sectional dimensions of each form, due to the correspondingly increased lever arm through which the pressure forces can operate, and it is particularly important to counteract them in each of the beam forms, due to the substantially greater depth of the beam forms as compared with the column forms. Special techniques have therefore been developed in accordance with the invention for controlling the hydrostatic forces of the fluid concrete to prevent them from effecting permanent deformation of the forms from the rectangular cross section which is the optimum configuration, and these techniques are illustrated diagrammatically in FIGS. 13–16.

Figure 13:
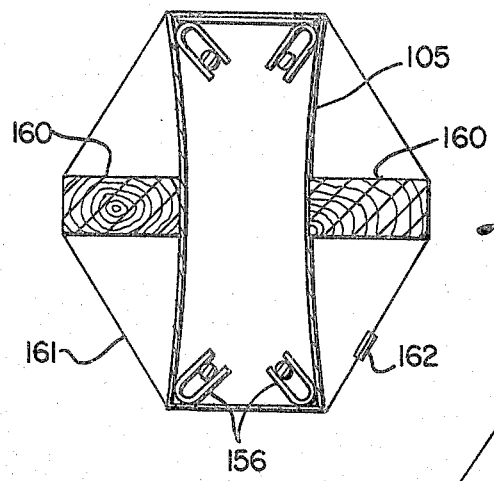
FIG. 13 is a diagrammatic sectional view illustrating the compression of one of the beam forms of the invention to concave curvatures of its opposed side walls prior to being filled with concrete.

Referring particularly to FIG. 13, preferred results have been obtained in the practice of the invention if before any concrete is poured, all of the beam forms which are ready to be filled with concrete have their opposed sides compressed to a concave configuration by yieldable force calculated to allow the compressed walls to expand to essential flatness in response to the hydrostatic pressure developed by fluid concrete filling the form. This negative curvature is achieved by waler means, such as 2×4's 160, which extend the full length of the middle of the opposed sides of the form 105 or 106, and are forced inwardly of the rectangular outline of the form by steel bands 161 which completely encircle the form and have their ends secured together by conventional clip means 162.

In the commercial practice of the invention, it is entirely feasible to calculate the precise tension necessary for the bands 162 for beam forms of any selected dimensions and concrete of predetermined fluidity. As a specific example of this phase of the practice of the invention, however, it can be stated that for beam forms 1 ft. wide and 2 ft. deep, the centers of the opposed side walls of the form should each be compressed substantially 0.160 inch inwardly of the plane they would occupy if they were essentially flat. When this degree of compression is established by means of 28-gauge steel bands ¾ inch wide under 266 pounds tension at locations 2 feet apart, the initially compressed side walls of the form will return to essential flatness when the form is completely filled with fluid concrete, and will of course retain that flat configuration after the concrete has set.

Figure 14:
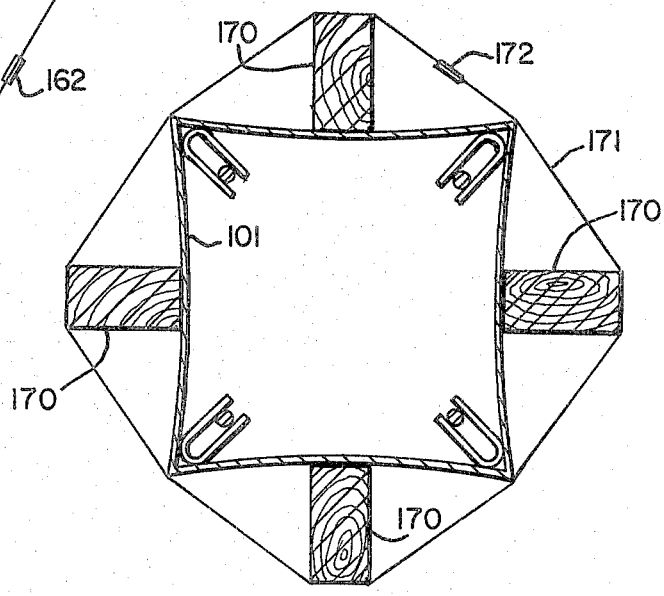
FIG. 14 is a view similar to FIG. 13 illustrating the corresponding initial compression of the opposed side walls of a column form.
Figure 15:
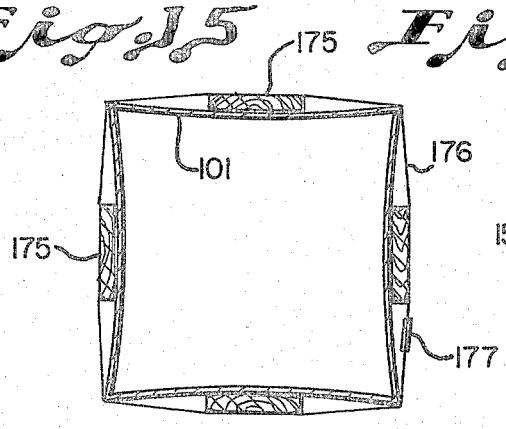
FIG. 15 is a view similar to FIG. 14 showing a modified arrangement.
Figure 16:
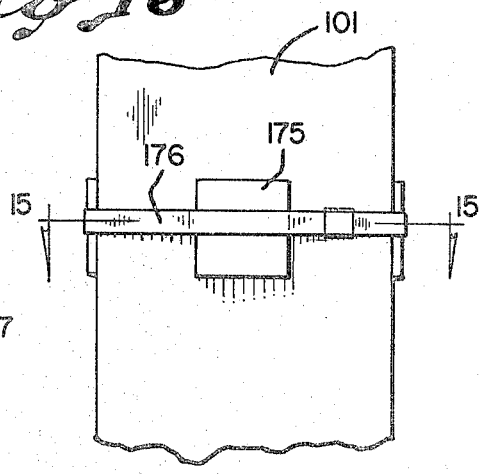
FIG. 16 is a fragmentary view taken at right angles to FIG. 15.

FIGS. 14–16 show alternative arrangements for similarly preloading the column forms 101 in order to obtain substantially flat final side walls. In this connection, it should be noted that for column forms of relatively small size, e.g. 1 ft. square, the flanges 111 provide such a definite stiffening action for the side walls of the form in which they appear that it is necessary to provide only the other two side walls of the form with an initial concave curvature. For column beams of larger section, however, it will usually be necessary to provide all four walls with an initial concave curvature.

In FIG. 14, the column form 101 is shown as provided on all four sides with waler means comprising 2×4's 170. The arrangement of bands 171 and clips 172 is the same as already described in connection with FIG. 13.

In FIGS. 15–16, the means for initially compressing the walls of the form 101 comprise a plurality of wood plugs 175, e.g. 2 inches square by a thickness which may vary from substantially ¾ inch to 2 inches, together with bands 176 and clips 177. These plug and band assemblies should be located at appropriately spaced intervals along the height of the column, e.g. 16 inch intervals.

While in theory the hydrostatic load applied internally of the vertical forms will vary from a maximum at the base of the column to a minimum at the upper level of the beam forms, it is well known in the industry that fluid concrete does not exhibit the same hydrostatic pressure characteristics as liquids, in that it achieves a maximum at relatively low static head, i.e. 12 to 15 feet, which does not substantially vary as that head increases. Therefore the degree of negative curvature initially imparted to the column forms can be the same for the full height of the column form, having in mind that it is not desirable to pour more than one floor of a building framework at a time, since otherwise the concrete would tend to overflow beam forms from column forms extending above them.

As already noted in connection with the beam forms, commercial practice of the invention will be facilitated by the provision of an appropriate set of tables listing the deflection and tension required fo optimum results with beam forms of different cross sections and heights. As a specific example of the values involved, it can be stated that for a column form constructed as shown in FIG. 12 which is 1 ft. square and 20 ft. high, the desired results are obtained when the form is provided with walers encircled by 28-gauge steel bands ¾ inch wide at locations 12 inches apart under 655 lbs. tension, which will provide an initial compression of the centers of the form walls of 0.316 inch. These conditions are exaggerated in FIG. 14 for illustrative purposes.

In addition to establishing flat sides on the completed columns and beams, the band and waleer assemblies of the invention offer the further advantage of supplementing the welded connections between the U-shaped or L-shaped members of which the column and beam forms are composed. Thus this feature of the invention makes it possible and practical to secure the form members together by relatively widely spaced stitch welds, e.g. at twelve inch increments. In the absence of the band and waler assemblies, full seam welding ould be needed to sustain the hydrostatic pressure of the fluid concrete, which would add considerably to production costs while still not otherwise improving practice of the invention or the quality of the resulting building framework.

In the practice of the invention, the column and beam forms are preferably shipped to the site with each form having the proper skeleton of reinforcing bars secured therewithin as already described. All column forms which are to be mounted on the slab 100, whether they are single or multiple story forms, are erected first, and the beam forms for the second floor are permanently secured thereto, also as already described.

Usually it is easier to postpone the mounting of beam forms for upper floors until the beams for the second floor have been poured and set. It is also essential that before any concrete is poured, proper shoring, which may be of any type conventionally used with removable forms for reinforced concrete beams, be installed below all beam forms. It has been found, however, that shoring posts can be much more widely spaced along the beams than with conventional removable forms, e.g. at 10-foot intervals for the forms of the invention as compared with conventional spacings of 3 feet for removable beam forms of conventional plywood construction.

Before any concrete is poured, lengths 180 of reinforcing bars should be installed in bridging relation with the joints between all abutting forms. For example, lengths of reinforcing bar material should be connected in splice fashion, secured as by wire ties, to the end portions of the reinforcing bars in each beam form in such manner as to project into the column or other beam forms to which such beam form is connected. In addition, wherever there is a column form on which a second column form is to be subsequently mounted, lengths of reinforcing bar material should be splice connected to the upper end portions of the reinforcing bars 140 in the already erected column form to project above the upper end of that form. In either of these cases, the splicing lengths of bar material may be right angled to provide one leg in the beam and the other leg in the adjacent column, as indicated at 181.

When all of these preliminaries have been completed, particularly including the compressing of the forms as described in connection with FIGS. 13–15, it is in order to pour enough concrete to fill the lowest level of mounted beam forms and the column forms on which they are mounted. This can be done conveniently by pumping or pouring the fluid concrete through the open slots in the top of each beam form, from which it will flow endwise into the adjacent column forms until they are filled. Conventional vibrating means can be suspended in the column forms and withdrawn upwardly as the column forms fill, or external vibrating machines can be attached to the forms. Upon the completion of this pouring operation, and while the poured concrete is still soft, additional inter-connecting reinforcing bars can be set in it where they may be needed, such particularly as the right angled bars 123 which will subsequently serve to anchor the slabs 120–121 to the concrete in the beam forms 106.

Figure 17:
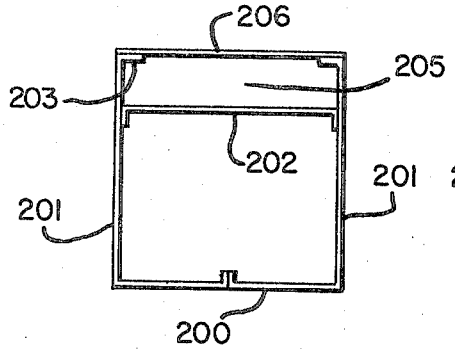

FIGS. 17–23 illustrate the adaptability of the invention to column and beam forms of different shapes, sizes and specific purposes. Thus FIG. 17 shows a column form 200 designed to house both a reinforced concrete column and a chase for piping and/or electric wiring, etc. The form 200 is initially fabricated from a pair of L-shaped sheet metal members 201 similar to the beam form members 115, and a flat channel shaped member 202. These members are welded together with the member 202 spaced inwardly of the flanges 203 on the members 201 to leave a space 205 between itself and the plane defined by the flanges 203. Only that portion of the form inwardly of the member 202 is filled with reinforced concrete, the space 205 being reserved for piping and/or wiring, and subsequently being enclosed by a flat metal sheet 206 welded or bolted to the flanges 203.

Figure 18:
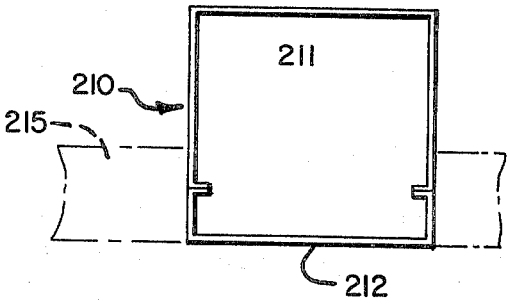
FIG. 18 is a diagrammatic cross section showing another modified column form in accordance with the invention to conceal form joints.

In FIG. 18, the column form 210 comprises a relatively deep flanged channel member 211 and a relatively shallow flanged channel member 212 welded together along the seam defined by their abutting flanges. The two channel members should be of such relative proportions that in the finished building, the welded seams therebetween will lie internally of the wall indicated fragmentarily at 215 so that only unbroken surface portions of the form can be visible in the finished building.

Figure 19:
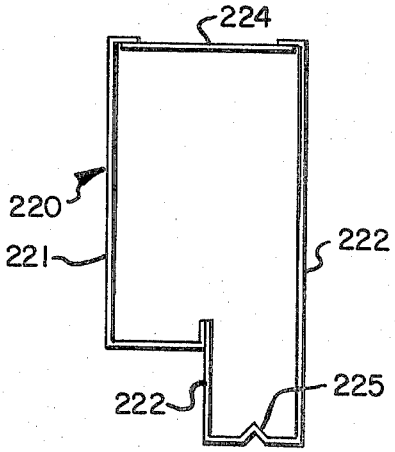
FIG. 19 is a diagrammatic sectional view showing a beam form in accordance with the invention with built-in drip strip along a window lintel.

FIG. 19 shows a form 220 especially designed to form a spandrel beam extending along the top of a window, with the specific objective of minimizing the possibility of water reaching the upper edge of the window from above. The L-shaped component 221 of form 220 may be identical with the components 115 already described. The L-shaped component 222 is deeper than component 221 along its lower edge, with a correspondingly higher flange 223, and the straps 224 correspond to the straps 118 in FIG. 10.

The bottom of the component 222 in FIG. 18 is provided with a groove 225 extending lengthwise thereof to form a drip strip, this groove being shown as internal in FIG. 19 although it can equally effectively be external. In the finished building, the component 222 will be on the outside, the frame for the window will lie immediately below the component 221, and any water running down the face of the building which travels inwardly along the bottom of the component 222 will drip therefrom when it reaches the groove 225 and is thereby prevented from reaching the upper edge of the window itself.

Figure 20:
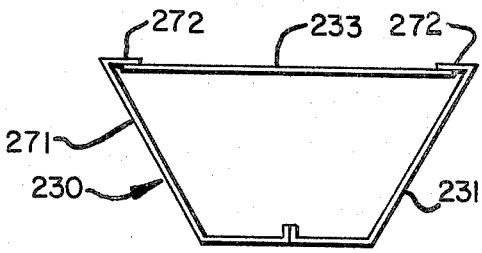
FIG. 20 is a diagrammatic cross sectional view showing a frustoconical beam form in accordance with the invention.

FIG. 20 illustrates a beam form 230 for the production of a flared beam of trapezoidal section. The L-shaped components 231 of the form accordingly have an obtuse internal angle, and an acute angle at the flanges 232. The same arrangement of straps 233 is used as in the other beam forms of the invention. Also in the use of this form, the opposed sides of the components 231 will be preloaded to concave curvatures in accordance with the principles already described in connection with FIG. 13. It is to be understood that a form of this or similar configuration is included within the term "rectangular" as used in the claims.

Figure 23:
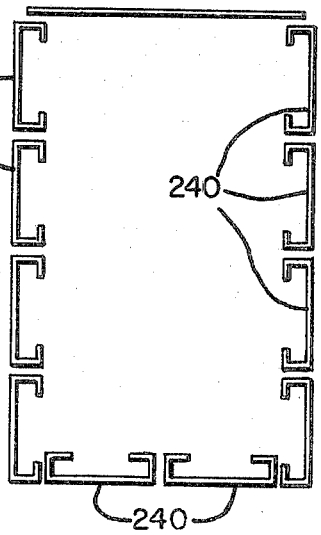
FIG. 22–23 are diagrammatic cross sectional views showing other beam forms in varied sizes in accordance with the invention.
Figure 22:
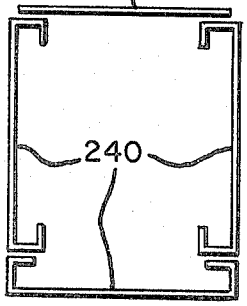
Figure 21:
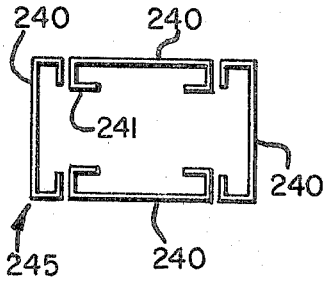
FIG. 21 is a diagrammatic cross sectional view showing another construction of column form in accordance with the invention.

FIGS. 21–23 illustrate several beam and column forms which may be produced in different proportions from multiple identical components 240 of relatively shallow channel shape in cross section and provided with inturned flanges 241. Thus in FIG. 21, a column form 245 is composed of four components 240 which are shown as separate from each other for clarity of illustration but are to be understood as welded together along their abutting edges to define a rectangular shape. The internal flanges 241 could be omitted from some of the components 240, but for simplicity of mass production and inventory control, all the components are advantageously of identical size and shape.

In FIG. 22, three components 240 are similarly shown as separate but actually would be welded together to define a beam form of essentially square cross section. The straps 246 in FIG. 21 correspond to the straps 118 in FIG. 10.

In FIG. 23, a beam form of rectangular section is similarly shown as composed of multiple components 240 and straps 246. The advantage of these modifications of the invention is that they limit the number of shapes of components which are needed to produce a variety of column and beam forms, all of which can be fabricated and loaded with the necessary reinforcing bar skeletons under factory conditions for shipment in ready to use condition to the building site.

While the methods and forms of apparatus herein described constitute preferred embodiments of the invention, it is to be understood that the invention is not limited to these precise methods and forms of apparatus, and that changes may be made therein without departing from the scope of the invention.

What is claimed is:

1. A system for building a structural framework on a foundation, comprising (a) a plurality of elongated metal shells of rectangular cross section, (b) means for securing certain of said shells to the foundation in horizontally spaced vertical positions defining the columns of the framework, (c) others of said shells being supported on said column shells in horizontally extending relation defining the beams of the framework, (d) means permanently securing adjacent ends of said beam shells together and to the adjacent said column shells with the interiors of adjacent said shells in interconnecting relation, (e) a plurality of reinforcing bars extending the full length of the interior of each of said shells, (f) means holding said reinforcing bars within each said shell in predetermined spaced relation with each other and with the inner surface of said shell, (g) reinforcing bars extending in bridging relation across each joint between adjacent said shells and in connected relation with said reinforcing bars within said adjacent shells, (h) said beam shells being open along the upper sides thereof to receive fluid concrete in sufficient quantity to fill the interiors thereof and of said column shells below said beam shells and to cooperate with said reinforcing bars in retaining said shells in rigidly interconnected relation defining the structural framework, (i) means compressing the opposed side walls of each of said beam shells to predetermined concave curvatures, and (j) said compressing means having:

(aa) predetermined limited yield characteristics providing for substantial flattening of said side walls in response to the hydrostatic pressure of fluid concrete substantially filling said beam shells;

(bb) waler means engaging each of said opposed side walls of said column shells, (cc) a plurality of band means of limited yieldability spaced vertically in encircling relation with said column shells and said waler means, and (dd) means holding said band means in predetermined tension calculated to balance the hydrostatic pressure developed by fluid concrete substantially filling said column shells with said opposed side walls substantially flat.

2. A building system as defined in claim 1 wherein said beam shells which extend along the outside of said framework each comprise a vertical inner side wall defining a shelf along the upper edge thereof, a horizontal bottom wall, and a vertical outer side wall of a predetermined greater height than said inner side wall to provide a portion thereof projecting upwardly beyond the horizontal plane defined by said shelves, said framework further comprising floor supporting means having the outer edges thereof supported on said shelves inwardly of said upwardly projecting portions of said outer side walls to provide spaces therebetween, and said upwardly projecting side wall portions forming dams for retaining a layer of fluid concrete poured on said floor supporting means and into said spaces.

3. A building system as defined in claim 1 wherein said column shelves each comprise (a) a generally U-shaped shell member, (b) an inner wall member permanently secured between the opposed side walls of said shell member in inwardly spaced relation with the edges of said shell member to define a space within said shell member outwardly of said inner wall member, (c) said space representing a minor fraction of the cross section of said shell member proportioned to define a vertical chase for receiving piping and/or wiring, and (d) an outer wall member secured to said shell member side walls outwardly of said inner wall member to close said chase.

4. A building system as defined in claim 1 wherein certain of said beam shells which extend along the outside of said framework each comprise (a) a vertical inner side wall, (b) a vertical outer side wall proportioned to provide a portion thereof depending below the level of the lower edge of said inner side wall, (c) horizontal bottom walls extending inwardly of said shell from the lower edges of both of said side walls at correspondingly different levels, (d) wall means connecting the inner edges of said bottom walls and cooperating with the inner of said bottom walls to form a seat for the upper edge of a window frame, and (e) means forming a groove extending lengthwise of the outer of said bottom walls for limiting flow of liquid along said outer bottom wall inwardly of said groove.

5. The method of constructing a structural framework comprising (a) mounting a plurality of elongated metal shells of rectangular cross section in horizontally spaced vertical positions defining the columns of the framework, (b) said column shells being substantially totally closed along all four sides thereof, (c) securing a plurality of other elongated rectangular metal shells on said column shells in horizontally extending relation defining the beams of the framework with the interiors of adjacent said beam and column shells in interconnecting relation, (d) said beam shells being open along the upper sides thereof to receive fluid concrete, (e) mounting a plurality of reinforcing bars within each of said shells to extend the full length of each said shell in predetermined spaced relation with each other and with the inner surface of said shell, (f) connecting reinforcing bars in bridging relation across each joint between adjacent said shells, (g) compressing the opposed side walls of each of said beam shells to predetermined concave curvatures by predetermined yieldable force calculated to balance the hydrostatic pressure developed by fluid concrete substantially filling said bean shells with said side walls substantially flat, (h) filling said interconnected shells with fluid concrete until said compressed shell side walls are substantially flat, and (i) compressing opposed side walls of each of said column shells to predetermined concave curvatures by predetermined yieldable force calculated to balance the hydrostatic pressure developed by fluid concrete filling all of said shells substantially to the tops of said beam shells with said beam shell side walls substantially flat.

6. The method defined in either of claims 5 wherein the step of compressing each of said opposed shell walls is carried out by applying waler means to the exterior of said walls, encircling said waler means with bands of limited yieldability at spaced locations along the length of said shell, and tensioning said bands to predetermined tension.

* * * * *